US009611615B2

(12) United States Patent
Davis et al.

(10) Patent No.: US 9,611,615 B2
(45) Date of Patent: Apr. 4, 2017

(54) APPARATUS AND METHOD FOR STABILIZING A SLAB FOUNDATION

(71) Applicant: Texas Pro-Chemical Soil Stabilization, Inc., Rowlett, TX (US)

(72) Inventors: Eric L. Davis, Forney, TX (US); John S. Horn, Rowlett, TX (US)

(73) Assignee: Texas Pro-Chemical Soil Stabilization, Inc., Rowlett, TX (US)

( * ) Notice: Subject to any disclaimer, the term of this patent is extended or adjusted under 35 U.S.C. 154(b) by 0 days.

(21) Appl. No.: 15/293,532

(22) Filed: Oct. 14, 2016

(65) Prior Publication Data

US 2017/0030046 A1 Feb. 2, 2017

Related U.S. Application Data

(63) Continuation-in-part of application No. 14/598,014, filed on Jan. 15, 2015, now Pat. No. 9,493,925.

(60) Provisional application No. 62/010,873, filed on Jun. 11, 2014.

(51) Int. Cl.

| | |
|---|---|
| ***E02D 31/10*** | (2006.01) |
| ***E02D 19/16*** | (2006.01) |
| ***E02D 19/18*** | (2006.01) |
| ***E02D 3/12*** | (2006.01) |
| ***E02D 27/02*** | (2006.01) |
| ***E02D 3/10*** | (2006.01) |
| ***E02D 19/22*** | (2006.01) |

(52) U.S. Cl.

CPC ..... *E02D 31/10* (2013.01); *E02D 3/10* (2013.01); *E02D 3/12* (2013.01); *E02D 19/16* (2013.01); *E02D 19/18* (2013.01); *E02D 19/22* (2013.01); *E02D 27/02* (2013.01)

(58) Field of Classification Search

CPC ..... E02D 19/16; E02D 19/06; E02D 19/12; E02D 19/18; E02D 19/22; E02D 31/06; E02D 31/08; E02D 31/10; E02D 17/12; E02D 3/10; E02D 3/12

See application file for complete search history.

(56) References Cited

U.S. PATENT DOCUMENTS

| | | | | |
|---|---|---|---|---|
| 1,728,736 A * | 9/1929 | Shergold | E04B 1/98 52/167.1 |
| 4,015,432 A * | 4/1977 | Ball | E02D 31/02 405/229 |
| 4,508,472 A * | 4/1985 | Handy | E02D 31/10 405/229 |
| 4,678,369 A * | 7/1987 | Glaser | E02D 31/00 405/129.7 |

(Continued)

*Primary Examiner* — Brian Glessner
*Assistant Examiner* — Paola Agudelo
(74) *Attorney, Agent, or Firm* — Whitaker Chalk Swindle & Schwartz PLLC; Stephen S. Mosher

(57) ABSTRACT

A method for stabilizing a slab foundation comprises a narrow, vertical moisture barrier assembly spaced outside and surrounding the perimeter grade beam of the slab foundation by a predetermined distance, and extends to preferably five feet below surface grade. The narrow trench for the barrier is preferably less than three inches wide. A membrane formed of a synthetic composition forms a moisture barrier against one wall of the narrow trench, and is held in place by back fill. The moisture barrier is intended for use in expansive soils that are subject to shrinking and swelling.

12 Claims, 4 Drawing Sheets

(56) References Cited

U.S. PATENT DOCUMENTS

| | | | | |
|---|---|---|---|---|
| 5,454,668 | A * | 10/1995 | Liao | E02D 19/18 405/109 |
| 7,971,602 | B2 * | 7/2011 | Lewis | E03B 1/04 137/357 |
| 8,689,506 | B2 * | 4/2014 | Fornatora | E02D 31/02 52/169.14 |
| 2007/0028557 | A1 * | 2/2007 | Kelly | E02D 27/34 52/741.15 |
| 2013/0071186 | A1 * | 3/2013 | Ekern | E02B 11/00 405/45 |

* cited by examiner

APPARATUS AND METHOD FOR STABILIZING A SLAB FOUNDATION

CROSS REFERENCE TO RELATED APPLICATIONS

The present U. S. Patent Application is a Continuation-In-Part Application of U.S. patent application Ser. No. 14/598,014, filed Jan. 15, 2015, entitled APPARATUS AND METHOD FOR STABILIZING A SLAB FOUNDATION, which claims priority to U. S. Provisional Patent Application Ser. No. 62/010,873, filed Jun. 11, 2014 with the same title and filed by at least one of the inventors named in the present Application.

BACKGROUND OF THE INVENTION

1. Field of the Invention

The present invention generally relates to soil stabilization and more particularly to stabilizing active soils at building sites that are subject to significant shrinking and swelling due to variations in moisture content.

2. Background of the Invention and Description of the Prior Art

Shrinking and swelling of soil upon which a building foundation is constructed is a well-known problem in the building industry particularly for residential structures. Soils such as clay, for example, that have a relatively high plasticity index, often termed "expansive soils," typically lack sufficient stability to avoid foundation damage due to moderate or wide variations in the moisture content of the soil upon which the foundation is constructed. In a typical slab foundation with a perimeter grade beam, which surrounds the perimeter of the slab, the moisture content of the soil inside the perimeter grade beam can vary substantially from the moisture content of the soil outside the perimeter grade beam. This is because the outside soil is subject to widely varying amounts of moisture due to cycles of rainfall or lack thereof throughout the seasons of the year, while the soil within the perimeter grade beam is isolated from such moisture variations.

A substantial variety of businesses have been active and successful over the years in responding to the need for remediation of the conditions that cause foundation shifting, cracks, masonry cracks in the building veneer, cracks in the interior walls of the structure, doors that won't close properly, plumbing systems that develop leaks, etc., all due to shifts on the soil upon which the building foundation is constructed. Many of these remedies involve construction of foundation supports to level the foundation, to provide support down to more solid subsurface components, to provide auxiliary supporting posts, beams, and the like to provide a stronger foundation less susceptible to flexing, cracking, and the like. Other kinds of remedies may involve providing injection of chemicals or fluids into the soil, or controlled moisture or irrigation systems to provide a more uniform moisture content year-round.

Such remedies tend to be expensive and are often subject to individual skills or techniques used in a particular situation. Some are satisfactory over the long term life of the structure; others must be rebuilt or replaced with other remediation countermeasures. What is needed is a solution to the problem that is provided at the time the foundation is initially constructed or that is inherent in the design of the foundation. A solution that prevents damage to a foundation regardless of the moisture variations that occur in the soil it is built upon would minimize damage to structures built on the slab foundation and negate future needs to reconstruct the foundation or to later install countermeasures to correct this troublesome problem.

SUMMARY OF THE INVENTION

Accordingly there is provided a novel design solution to the problem of the variability of moisture content of high plasticity or expansive soils upon which slab foundations having perimeter grade beam construction are built that is an advance in the state of the art. The solution to be described is economical in both the labor needed to provide it and in the materials required for its construction. Moreover it has the ability to be approved by local codes.

In one embodiment the invention is an apparatus for stabilizing a slab foundation, comprising a vertical moisture barrier assembly spaced outside the perimeter grade beam of the slab foundation by a predetermined distance, surrounding the slab foundation, and extending to a predetermined depth below surface grade determined by the type of soil upon which the slab foundation is to be constructed.

In one aspect, the vertical moisture barrier assembly comprises a narrow trench excavated to the predetermined depth below surface grade as determined by the type of soil, and a moisture barrier sheet formed of a synthetic composition forming a planar surface disposed against one wall of the narrow trench from the depth dimension below surface grade to a predetermined extension above the surface grade.

In another aspect, the narrow trench comprises a nominal width not exceeding three inches and having a depth of approximately five feet for use in soils having a relatively high plasticity index that are subject to shrinking and swelling.

In another aspect, the vertical moisture barrier assembly further comprises a backfill component of soil filling the narrow trench to the surface grade for holding the moisture barrier sheet against substantially the entire surface of the one wall thereby maintaining its planar form within the narrow trench.

In other aspects, the predetermined distance comprises a distance approximately equivalent to the nominal thickness of the grade beam of the slab foundation, and the predetermined depth comprises a dimension of approximately five feet below the surface grade.

In another aspect, the synthetic composition of the moisture barrier sheet comprises a multi-layer plastic sheet extrusion manufactured from virgin polyolefin resins and having a nominal thickness of approximately 15 mils. In preferred embodiments, the multi-layer plastic sheet meets or exceeds ASTM E 1745 Class A, B & C standard Specification for Water Vapor Retarders Used in Contact with Soil or Granular Fill Under Concrete Slabs.

In another aspect, the predetermined extension of the moisture barrier sheet or membrane comprises a dimension approximately twice the nominal thickness of the grade beam of the slab foundation.

In another aspect, the backfill component of soil comprises soil excavated from the narrow trench or its equivalent, In an alternate embodiment, a method for stabilizing a slab foundation comprises the steps of preparing the surface grade for a slab foundation having a slab extension of the slab foundation beyond the perimeter of the location of a grade beam for the slab foundation; excavating a vertical barrier trench around and spaced a predetermined distance outside the location of the grade beam, wherein the vertical barrier trench is less than or equal to four inches wide and at least three feet deep below the surface grade; installing a moisture barrier membrane in the vertical barrier trench; excavating the grade beam trench; draping an extension of the moisture barrier over the surface grade and into the grade beam trench and secure it to the outer wall of the grade beam trench; installing rebar, slab strands and chairs, and plumbing lines; and pouring concrete for the grade beams and the slab foundation including the slab extension.

In other aspects, improvements to the method includes steps comprising: excavating the trench to a full depth of approximately 5 feet, wherein the width of the trench does not exceed six inches at surface grade and three inches at the full depth (there are variations of this additional step wherein the width of the trench at the surface grade may vary from three to six inches depending on soli conditions, etc.); installing vertical braces at least three inches wide in the trench at intervals of six to 10 feet therealong thereby providing temporary support for the side walls of the trench; installing the moisture barrier membrane against an outer wall of the vertical barrier trench wherein the membrane wraps around corners and extends from the full depth below surface grade to a predetermined extension above the surface grade; stapling the membrane to the vertical braces for providing temporary support; and mixing sand with the backfill soil as necessary to preserve porosity within a stable range.

DETAILED DESCRIPTION OF THE INVENTION

The invention to be described is a solution to the problem of soil moisture content variations due to, for example, seasonal and climatic variations that occur in many climate regions in the United States and elsewhere, or poor soil moisture maintenance practices in most locations. It is a solution that is provided at the time the building foundation is initially constructed so that the foundation needs no remedial repairs or counter measures years after it is built. The novel solution described herein prevents damage to a foundation regardless of the moisture variations that occur in the soil beyond the perimeter of the building. This solution thus negates future needs to repair or reconstruct the foundation, or to later install foundation support countermeasures to correct this troublesome problem. The invention is well-suited for slab-on-grade foundations constructed on expansive clay soils often found in, for example, California and Texas. The apparatus and method described herein is economical both in labor and materials, and is designed meet or exceed local building code requirements.

Briefly stated, the invention provides an apparatus and method for stabilizing the soil moisture content on both sides of the grade beam of a slab foundation to isolate or immunize the foundation from the effects of soil moisture variations. The apparatus comprises a vertical moisture barrier assembly spaced outside the perimeter grade beam of a slab foundation by a predetermined distance. The method comprises a process for constructing a slab foundation having the vertical moisture barrier assembly. The vertical moisture barrier assembly surrounds the slab foundation and extends to a depth below surface grade that is preferably five feet but may be determined by the type of soil upon which the slab foundation is to be constructed. The concept underlying the invention is that by providing an easily constructed, low cost, vertically-disposed auxiliary moisture barrier around and outside of the slab foundation's perimeter grade beam, and spaced a nominal distance outside the perimeter grade beam, the moisture content of the soil on both sides of the perimeter grade beam is maintained at a constant value, regardless of the moisture conditions outside the vertical moisture barrier due to variations in rainfall, foundation irrigation, landscape watering, etc. Under such conditions the slab foundation itself is much less likely to suffer stresses due to moisture variations that result in damage to the foundation and to the exterior and interior structure of the building that it supports.

Figure 1:
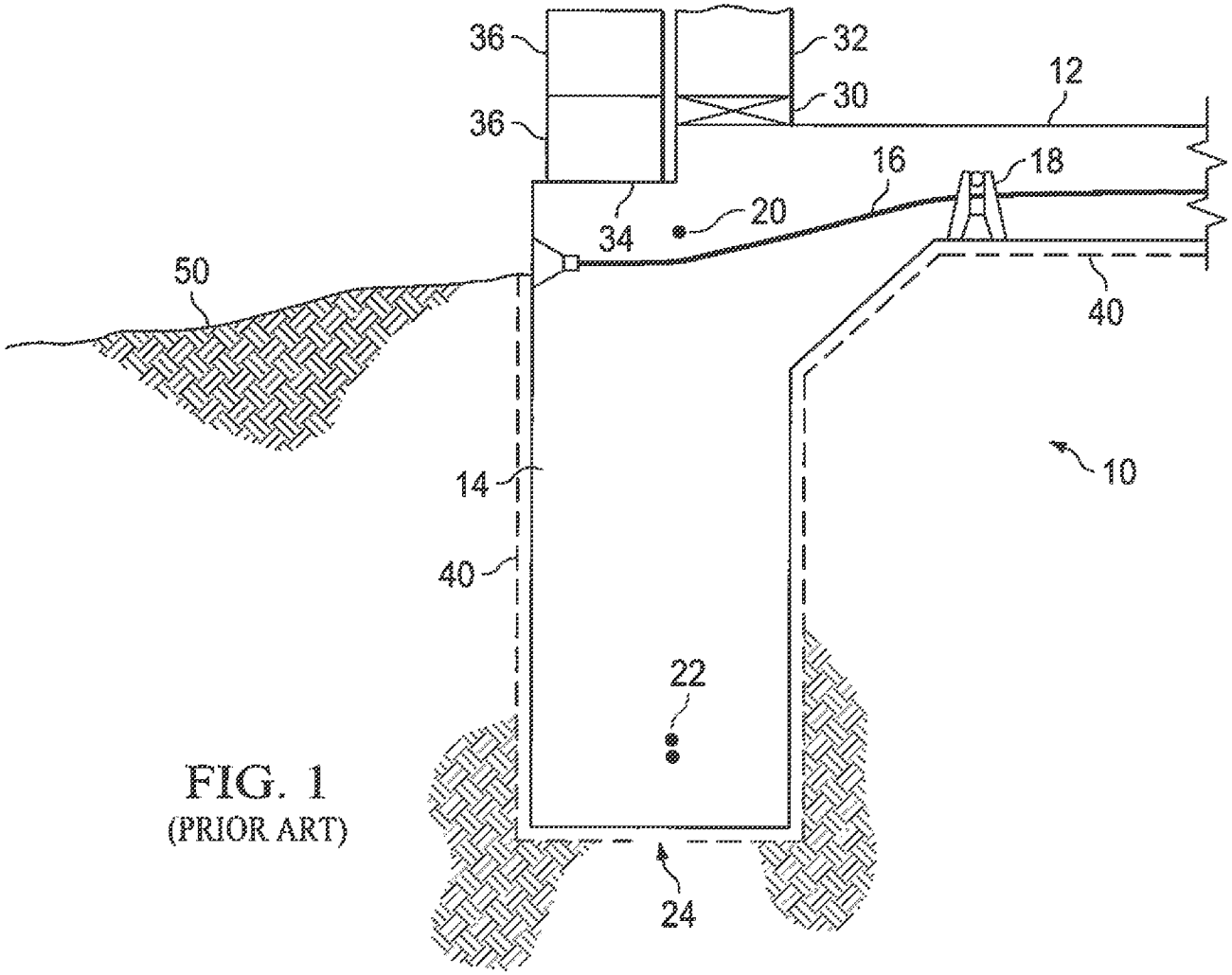
FIG. 1 (PRIOR ART)
FIG. 1 illustrates the cross section of a conventional prior art slab foundation viewed along a grade beam at one edge of the slab.

FIG. 1 illustrates the cross section of a conventional prior art slab foundation viewed along a grade beam at one edge of the slab. The conventional slab foundation 10 includes a slab 12 formed of concrete integral with a grade beam 14, the grade beam being disposed in a trench 24 that is excavated into the earth's surface to a typical depth of approximately two to three feet below surface grade 50. The foundation includes reinforcing slab strands 16,20 supported on chairs 18 and draped beam strands 22 within the grade beam space to be occupied by the concrete when it is poured in place. The slab may include a membrane 40—typically a 6 mil polyethylene sheet—to line the outside and inside surfaces of the grade beam 14 and the underside of the slab 12. The edges of the slab foundation include a surface for securing the sill plate 30 and a seat or ledge 34 for positioning the exterior wall veneer such as brick or stone 36. The problem with this prior art construction, when the soil is subject to substantial moisture content variations, is that the soil under the slab 12 and bounded around the perimeter of the slab 12 by the grade beams 14 tends to remain at a constant moisture content while the soil outside the perimeter of the grade beam 14 may vary significantly due to rainfall variations that can be substantial in some regions. If the foundation is constructed on expansive soils such as clay, the volume occupied by the soil outside the grade beam 14 as it expands and contracts with variations in moisture content can vary sufficiently to exert significant bending forces on the slab. This set of conditions often leads to fractures in the slab and exterior and interior walls, misaligned doors and sometimes even cracks in plumbing that passes through the grade beams, etc.

Figure 2:
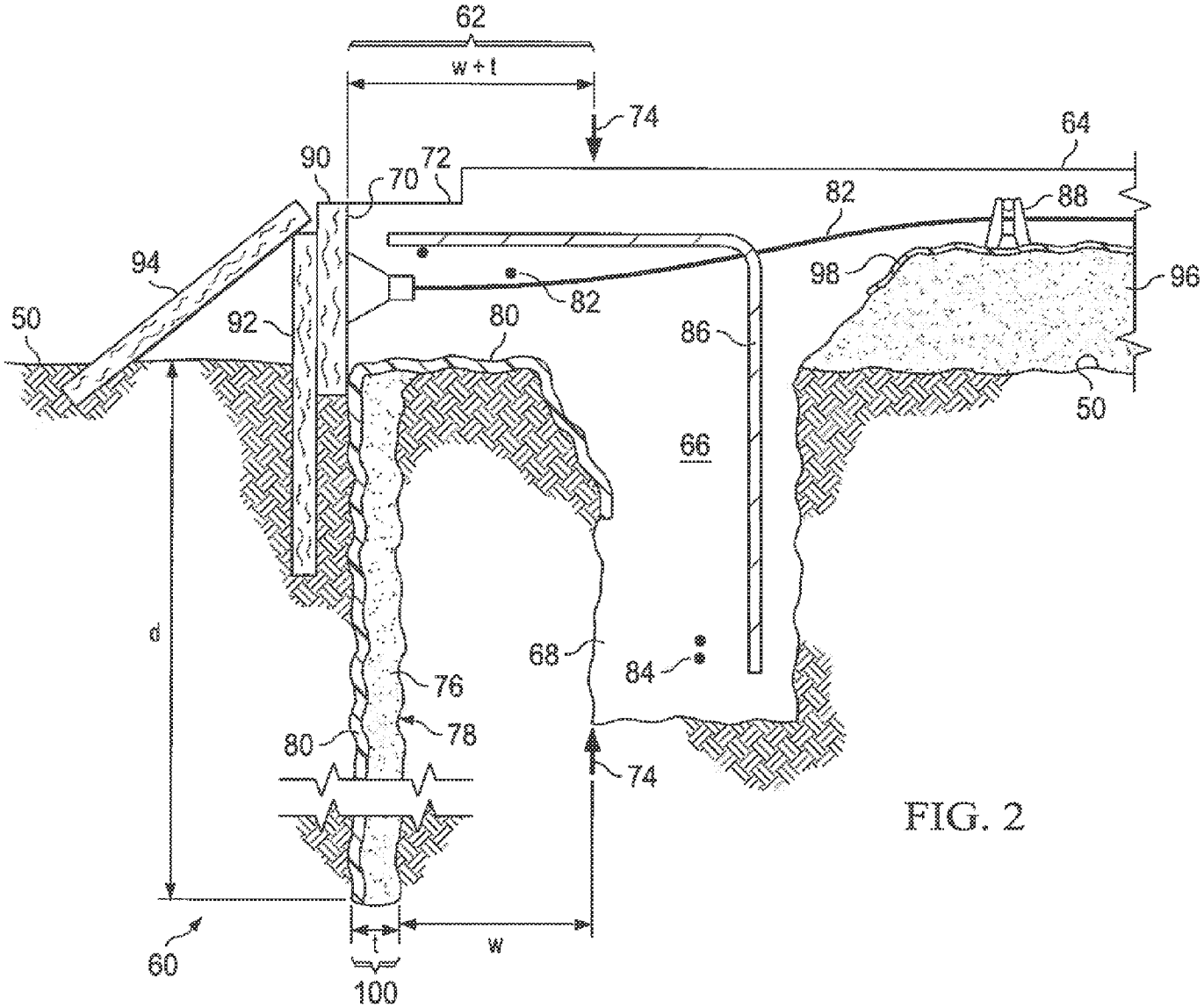
FIG. 2 illustrates the cross section of one embodiment of a stabilized slab foundation with a vertical moisture barrier assembly according to the present invention.

FIG. 2 illustrates the cross section of one embodiment of a novel, stabilized slab foundation 60 that includes a vertical moisture barrier assembly (76, 78, 80, which is collectively designated vertical barrier assembly 100) according to the present invention. In the description that follows, it is assumed that the site has been prepared and the foundation outlined with chalk, etc. so that the narrow trenches can be properly located. The slab foundation 64 is constructed on a surface grade 50 and depicted in a cross section view that includes a reinforced slab extension 62 that extends beyond the perimeter 74 of the grade beam 66, which is formed in the grade beam trench 68. Typical grade beams range between 8 to 12 inches wide but can vary beyond these figures. Situated in parallel with the grade beam 66 is a second, narrower, barrier trench 78. The barrier trench must be narrow to lessen the effect this second trench may have on the soil's ability to support the building. Further, the narrow trench 78 is placed well outside the location of the grade beam 66 by a predetermined distance w. The barrier trench 78 may be located by the predetermined distance w=9-½ inches outside the grade beam 66 in this example. In general the predetermined distance w is at least equal to or greater than the width of the grade beam. The barrier trench 78 is preferably narrow, having a width of t=2-½ inches (in this illustrative example), and no more than 3 inches wide. The barrier trench 78 must be narrow to avoid a loss of support for the slab foundation on the surface grade. Further, the outside walls of the grade beam trench 68 and the barrier trench 78 are separated by approximately 12 inches in this example, as indicated by the spacing 62 defined by the distance w +t, where w=spacing between the trenches, and t=the width of the barrier trench 78. This spacing also represents the distance 62 that the slab 64 extends beyond the perimeter 74 of the grade beam 66.

Disposed in the barrier trench 78 is a lining comprised of a moisture barrier membrane 80 that is held in place against the outer wall of the barrier trench 78 by back-filled soil 76. The height of the membrane 80 is actually the width of the material (to be described) when it is sized for use during construction of the vertical moisture barrier assembly 100. The total width of the membrane 80 is determined to extend above grade level by approximately 20 inches to 24 inches so that it can be wrapped over the surface grade 50 toward the grade beam trench 68. Thus, for a barrier trench 78 that is five feet deep, the total width of the membrane 80 would be approximately seven feet. The free edge of the membrane 80 is then secured against the upper portion of the grade beam trench 68 as will be described. The barrier trench 78 is preferably excavated to a depth of d=five (5) feet. However, while in some applications the minimum depth of d=2-½ feet is permissible, in general the preferred depth for providing the intended vertical moisture barrier assembly 100 is closer to five feet below the surface grade 50.

FIG. 2 includes other important details. The location of the form board 90, which may be installed after the membrane 80 is placed in the trench 78, is shown so that its inside surface 70 is disposed directly above the outside surface of the barrier trench 78 against which the membrane 80 is placed. The form board 90 may be supported by the stake 92, which may be further supported by an angled brace 94 as shown. Before the concrete for the slab 64 is poured, an optional sand cushion 96, preferably covered by a horizontal moisture barrier 98, may be installed as shown. The slab 64 preferably also includes the slab strands 82, 84, chairs 88, and re-bar 86, which are set in place prior to pouring the concrete for the grade beam 66 and the slab 64. The slab foundation 64, when poured, may include a brick ledge 72 as shown—a surface for positioning an exterior wall veneer such as brick or stone (similar to the veneer wall 36 as depicted in FIG. 1). After the concrete is poured and cured, the form boards 90 and its supports 92, 94 may be removed.

Several characteristics of the stabilized slab foundation 60 are essential to providing the ability of the invention to neutralize any instability that may result from variations in soil moisture content in the vicinity of the stabilized slab foundation 60. One is the addition of the vertical moisture barrier assembly 100 that is spaced outside the conventional perimeter of the slab 64 that is usually aligned with the outer side of the grade beam 66. Without the vertical moisture barrier assembly 100 in place, the soil moisture proximate the outside of the grade beam 66 is allowed to vary with climate changes, rainfall, landscape watering, etc. The resulting moisture content difference in the soil (a) inside the grade beam 66 and the slab 64 and (b) outside the grade beam 66 can exert substantial bending forces on the slab structure, resulting in cracks in the building structure as described herein above. The presence of the vertical moisture barrier assembly 100 prevents moisture from outside its perimeter from reaching the grade beam 66, thus maintaining equal soil moisture content on both sides of the grade beam 66. This structure substantially immunizes the slab 66 from the destructive forces exerted by expansive soils when exposed to variations in moisture, providing a stable slab foundation 60 that is not subject to the damage typically wrought by soil moisture variations.

The structure of the vertical moisture barrier assembly 100 comprises a very narrow vertical barrier trench 78 into which is positioned a membrane 80 that is held in place by backfilled soil 76 after the membrane 80 is placed against the outer wall of the barrier trench 78. After such placement, the excess width of the membrane 80 can be draped outwardly and over the form board 90, and secured with tape, nails, or screws, until the back filling step is completed. Then the grade beam (primary) trench 68 may be excavated, followed by re-positioning the excess membrane 80 inward toward the primary trench 68 and secured to its outer wall. Securing the membrane 80 material against the outer wall of the primary trench 68 may be accomplished using 16 penny nails, for example; i.e., just enough fastening to hold the membrane 80 in place while the concrete is being poured in to the grade beam trench 68.

The preferred material for the vertical moisture barrier membrane 80 is a multi-layer plastic extrusion manufactured of polyolefin resins, forming a rugged, 15 mil thick membrane that preferably meets or exceeds ASTM E 1745 Class A, B, & C Standard Specification for Water Vapor Retarders Used in Contact with Soil or Granular Fill Under Concrete Slabs. One preferred material is manufactured under the trade name Stego® Wrap Vapor Barrier by Stego Industries, LLC. of San Clemente, Calif. 92672.

Another characteristic of the stabilized slab foundation 60 that will be noticed by observant persons is the beefed up or reinforced slab extension 62 that extends the slab 64 outward past the grade beam 66. This portion 62 of the slab 64 may be constructed to be twice the thickness of the slab 64 that is within the grade beam perimeter 74. The purpose of this reinforced section 62 of the slab 64 is to provide sufficient load bearing support for the building exterior surface that may typically be brick or stone veneer on the brick ledge 70.

The excavation of the barrier trench 78 generally requires certain specialized equipment to provide a narrow trench—not to exceed three inches in width—that is preferably five feet deep below the surface grade 50. Moreover, the barrier trench 78 must be excavated before the grade beam (primary) trench 68 is excavated, to avoid disturbing the soil while excavating the grade beam trench 68. There are four known types of equipment mechanisms (not shown) for excavating trenches of this type. These mechanisms include devices modeled after or configured in the manner of a chain saw, a rotary or disc saw, a knife or slicing type device, or a back hoe. Each of these mechanism types must be driven by some apparatus that provides power, support, and control for the cutting blade assembly and a mechanism for excavating soil from the barrier trench 78. For example, a rotary or disc saw may be used to excavate such a narrow trench as described. However, because of the requirement for a very narrow secondary trench, the chain saw type mechanism may be the most practical, particularly for depths that exceed 2-½ or three feet. As is well known, a chain saw blade comprises a stationary blade having a continuous chain that travels along and around the edge of the stationary blade in a continuous fashion. A plurality of excavating teeth may be disposed at intervals along the chain in a spaced relationship appropriate to the function of the blade. A rotary or disc saw may be a round blade having a plurality of fixed teeth disposed at intervals in a spaced relationship around the perimeter of the disc. The stationary blade embodiment may be an elongated shape of a typical chain saw used for felling trees, or other shapes, including circular, oval, eliptical, etc. that may be adapted to excavating the narrow trench as described herein. If a blade structure is used, it may include one blade or several blades, and may be pulled or pushed through the earth. In addition, the blade structure, in particular the excavating implements or teeth of the chain saw—or the rotary or disc saw—needs to be configured for cutting through highly abrasive soil materials that frequently include hard materials such as rocks or metal objects, concrete debris, and the like.

Regardless of the type of mechanism used to excavate the narrow barrier trench 78, some skill is required to maneuver the cutting mechanism at the comers of the foundation plan. In general, the barrier trenches 78 along sides of the foundation will cross at the corners so that the depth of the barrier trench 78 is the full prescribed depth. The excess length of the barrier trenches 78 at each corner may then be back-filled after the vertical barrier 80 is installed. The sheets of material of the vertical barrier 80 may be folded together at the corners and sealed with cement formulated for that purpose. Such cement is available form the manufacturer identified above.

The method for constructing a slab foundation 60 that includes the vertical moisture barrier assembly 100 as described herein includes the following steps, with reference to the structures illustrated in FIG. 2.

(1) Excavate a vertical barrier trench 78 surrounding the location of a grade beam trench 68 for a slab foundation 60 and spaced a predetermined distance "w" outside the perimeter 74 of the grade beam trench 68, wherein the vertical barrier trench 78 is less than or equal to three inches wide and at least 2-½ feet deep below the surface grade 50;

(2) Install a moisture barrier membrane 80 against an outer wall of the vertical barrier trench 78 wherein the moisture barrier membrane 80 has a width from the bottom of the vertical barrier trench 78 to an extension approximately 20 inches above the surface grade 50;

(3) Install an exterior form board 90 for the slab foundation 50, such that its inside surface is disposed above and outside an outer wall of the vertical barrier trench 78;

(4) Drape the excess of the vertical moisture barrier extending above the trench 78 and outward over the form board 90;

(5) Backfill the vertical barrier trench 78 to the surface grade 50 to secure the moisture barrier membrane 80 against the outer wall of the vertical barrier trench 78;

(6) Excavate the grade beam trench 68; drape the excess width of the membrane 80 over the surface grade 50 and into the grade beam trench 68 and secure it to the outer wall of the grade beam trench 69;

(7) Install rebar 86, slab strands 82, 84 and chairs 88, and plumbing lines not shown because they do not form part of the invention; and (8) Pour concrete for the grade beams 66 and the slab foundation 60.

In a final step, after the concrete has cured, the form boards 90 and supports 92, 94 may be removed.

Persons skilled in the art understand that constructing a slab foundation on expansive soils is subject to good engineering design and expertise. The engineer designing a foundation using a moisture barrier must have knowledge and experience with both (1) the design of post-tension slab-on-ground on expansive soils; and (2) the appropriate design requirements referenced in recognized standards documents such as the ICC (International Code Council, a model building codes standards organization). Proper construction of a sound slab foundation also relies on the construction experience and expertise of the persons supervising the construction and installation of the slab foundation according to the present invention.

As with any novel construction method or process, there may be associated risks arise during construction or that are atypical from the usual experience. For example, foundation designs on expansive soils may be based on design equations derived empirically from past studies, and may rely on certain assumptions regarding soil behavior under varying conditions. The addition of the novel vertical moisture barrier described herein adds further factors to be considered in the design, and can increase the risks associated with slab foundation designs if good engineering practices are not followed in the design and construction of the inventive slab foundation configuration described above.

In an alternate embodiment of the invention a method of stabilizing a slab foundation using a vertical moisture barrier assembly is described with reference to FIGS. 3 and 4. Structures bearing the same reference numbers as appear in FIGS. 1 and 2 refer to the same structural feature. The method to be described includes several steps that in practice have been found to facilitate performance of the method of stabilizing a slab foundation. Broadly stated, the steps of the method comprise:

(1) preparing the surface grade for a slab foundation having a slab extension of the slab foundation beyond the perimeter of the location of a grade beam for the slab foundation;

(2) excavating a vertical barrier trench around and spaced a predetermined distance outside the location of the grade beam, wherein the vertical barrier trench is less than or equal to four inches wide and at least three feet deep below the surface grade;

(3) installing a moisture barrier membrane in the vertical barrier trench;

(4) excavating the grade beam trench;

(5) draping an extension of the moisture barrier over the surface grade and into the grade beam trench and secure it to the outer wall of the grade beam trench;

(6) installing rebar, slab strands and chairs, and plumbing lines; and (7) pouring concrete for the grade beams and the slab foundation including the slab extension.

Additional steps that improve the method during its installation, based on experience in constructing slab foundations using the method include:

(8) excavating the trench to a full depth of approximately 5 feet, wherein the width of the trench does not exceed six inches at surface grade and three inches at the full depth. There are variations of this additional step wherein the width of the trench at the surface grade may vary from three to six inches depending on soli conditions, etc.

(9) installing vertical braces at least three inches wide in the trench at intervals of six to 10 feet therealong thereby providing temporary support for the side walls of the trench.

(10) installing the moisture barrier membrane against an outer wall of the vertical barrier trench wherein the membrane wraps around corners and extends from the full depth below surface grade to a predetermined extension above the surface grade.

(11) stapling the membrane to the vertical braces for providing temporary support.

(12) mixing sand with the backfill soil as necessary to preserve porosity within a stable range.

Figure 3:
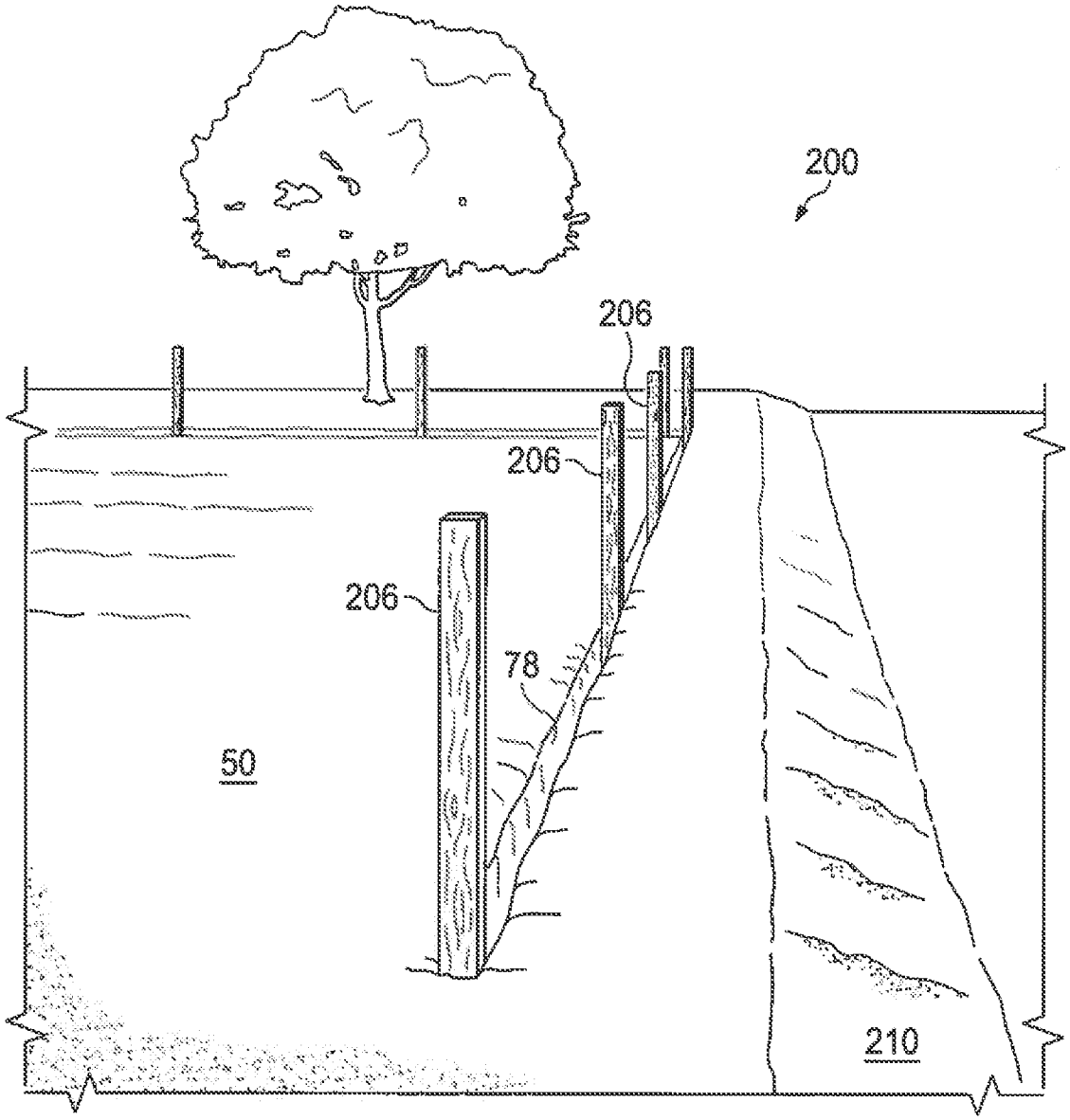
FIG. 3 illustrates a perspective view of a completed vertical barrier trench component of one embodiment of the present invention.
Figure 4:
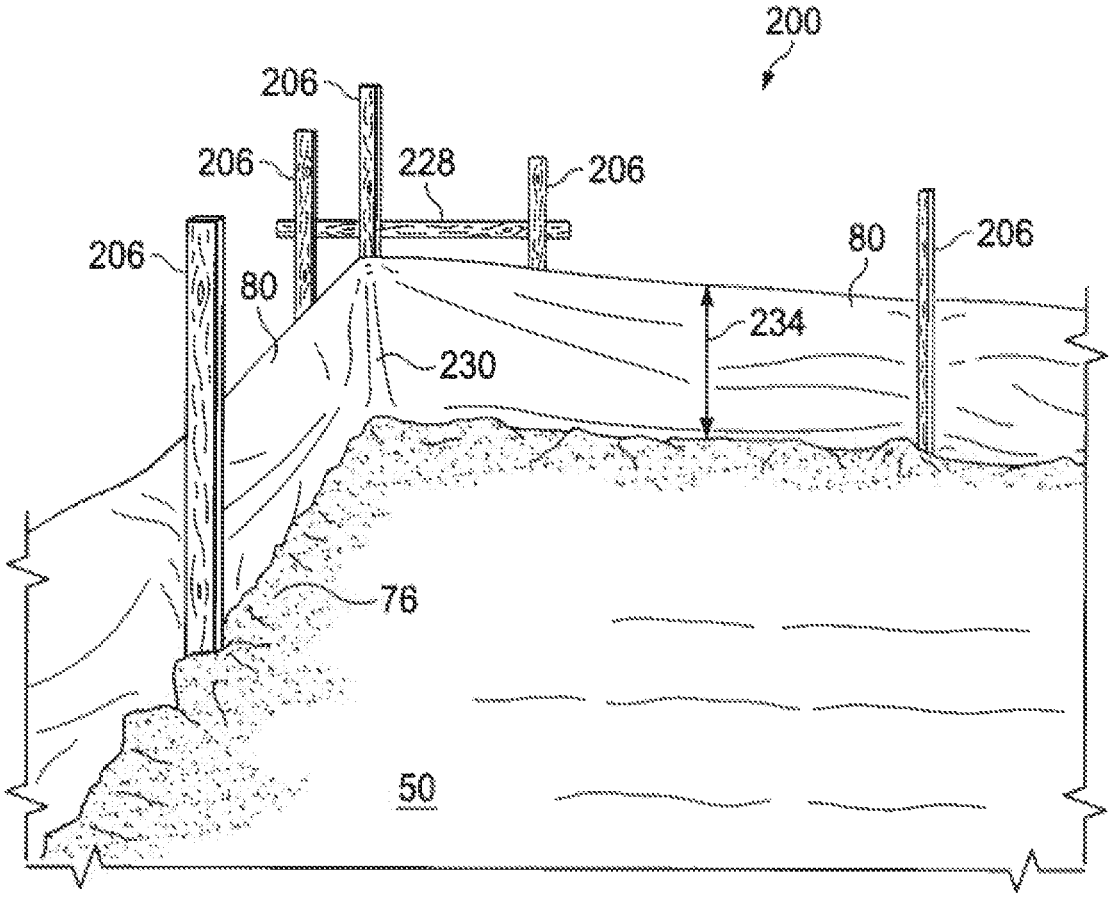
FIG. 4 illustrates a perspective view of one corner of a slab foundation site with a vertical moisture barrier installed.

The alternate method that includes these improvements is described with the aid of FIGS. 3 and 4. It will be noted that some of the same features depicted in FIGS. 3 and 4 are the same as in FIGS. 1 and 2.

FIG. 3 illustrates a perspective view of a completed vertical barrier trench component of one embodiment on the site of a slab foundation 200 under construction according to the method of the present invention. A portion of a prepared surface grade 50 that will be covered by the slab 64 is shown, with a narrow trench 78 excavated along one side of the prepared surface grade 50. The trench 78 shown is representative of a vertical barrier trench that completely surrounds the perimeter of the slab 64. Outside the trench 78 (to the right in FIG. 3) is excavated soil 210. The narrow trench 78 is the same structure as the vertical barrier trench 78 shown in cross section in FIG. 2. Inserted into the trench 78 are several upright stakes or braces 206 spaced typically at six to 10 foot intervals to support the side walls of the trench from collapse before the membrane 80 is installed in the trench 78. The braces 206 may preferably be eight foot lengths of wood supplied as 2"×3" lumber. The 3" width is preferably placed across the width of the trench 78 as shown. The braces 206 need not be pressed into the soil other than just enough to maintain their upright orientation.

The vertical barrier trench 78 should be excavated to a depth of at least three feet. In typical soil conditions a depth of five feet is preferred. The width of the trench 78 should be at least three inches at the full depth or bottom of the trench 78 five feet below the surface grade 50 and should preferably be no wider than four inches to 4-½ inches wide at the level of the surface grade 50. There may be some variation in these dimensions within the range of 1-½ inches at the full depth to six inches at the surface grade 50, particularly depending on the local soil conditions such as soil composition and soil moisture content.

FIG. 4 illustrates a perspective view of one corner 230 of a slab foundation site 200 with a vertical moisture barrier or membrane 80 installed in the trench 78 and backfill soil 240 installed in the trench 78. The membrane 80 is shown supported on the vertical stakes 206, typically by stapling the membrane 80 to the outside surface of the stakes 206 to provide temporary support for the membrane 80 while installation is in progress. Also shown is the membrane 80 placed in the trench 78 around the corner 230. Although not shown in the Figure, it is important that the membrane 80 be wrapped around the corner to the full depth of the trench 78, just as indicated by the portion of the membrane 80 that is above the surface grade 50. The membrane 80 at the corner 230 may be supported by the corner braces 226 that are braced by cross pieces 228. The membrane 80 is shown extending above the surface grade 50 by a distance 234 of at least 20 inches to 24 inches as shown. This "excess" portion of the membrane 80 will be draped inward over the surface grade 50 and secured into the grade beam trench 68 as previously described.

The installation of the membrane 80 in the vertical barrier trench 78 may be completed, following excavation of the grade beam trench 68, by removing the braces 206. In most cases they may simply be pulled upward from the vertical barrier trench after removing the staples that were used to temporarily support the membrane 80 while it was being installed in the trench 78 and the backfill soil 76 installed in the trench 78. The backfill soil 240 may typically be soil removed when the trench 78 was excavated. In some conditions, the backfill soil may be supplemented by sand to provide backfill soil 240 with an appropriate mix of characteristics to facilitate backfill and support of the membrane 80.

While the invention has been shown in only one of its forms, it is not thus limited but is susceptible to various changes and modifications without departing from the spirit thereof. Moreover, the vertical moisture barrier concept may find application in other construction projects built on the surface grade on expansive soils, such as roadways, railway crossings, and the like.

What is claimed is:

1. A method for stabilizing a slab foundation, comprising the steps of:

preparing the surface grade for a slab foundation having a slab extension of the slab foundation beyond the perimeter of the location of a grade beam for the slab foundation;

excavating a vertical barrier trench around and spaced a predetermined distance outside the location of the grade beam, wherein the vertical barrier trench is less than or equal to four inches wide and at least three feet deep below the surface grade;

installing a moisture barrier membrane in the vertical barrier trench;

excavating the grade beam trench;

draping an extension of the moisture barrier over the surface grade and into the grade beam trench and secure it to the outer wall of the grade beam trench;

installing rebar, slab strands and chairs, and plumbing lines; and pouring concrete for the grade beams and the slab foundation including the slab extension.

2. The method of claim 1, wherein the step of installing the moisture barrier membrane comprises the step of:

installing a synthetic membrane formed of a multi-layer plastic sheet extrusion manufactured from virgin polyolefin resins.

3. The method of claim 2, wherein the nominal thickness of the multi-layer plastic sheets is approximately 15 mils.

4. The method of claim 1, wherein the step of excavating a vertical barrier trench comprises the steps of:

excavating the trench to a full depth of approximately 5 feet, wherein the width of the trench does not exceed six inches at surface grade and three inches at the full depth; and installing three-inch wide vertical braces in the trench at intervals of six to 10 feet therealong thereby providing temporary support for the side walls of the trench.

5. The method of claim 4, wherein the step of installing a moisture barrier membrane comprises the steps of:

installing the moisture barrier membrane against an outer wall of the vertical barrier trench wherein the membrane wraps around corners and extends from the full depth below surface grade to a predetermined extension above the surface grade;

stapling the membrane to the vertical braces for providing temporary support; and backfilling the vertical barrier trench to the surface grade to secure the moisture barrier membrane against the outer wall of the vertical barrier trench.

6. The method of claim 5, wherein the step of backfilling comprises the steps of:

securing the membrane against substantially the entire surface of the outer wall thereby maintaining its planar form within the barrier trench; and backfilling the barrier trench with backfill soil excavated from the barrier trench.

7. The method of claim 5, wherein the step of backfilling comprises the step of:

mixing sand with the backfill soil as necessary to preserve porosity within a stable range.

8. The method of claim 1, wherein the step of excavating a vertical barrier trench comprises the steps of:

excavating the trench to a full depth of approximately 5 feet, wherein the width of the trench does not exceed four inches at surface grade and three inches at the full depth; and installing three-inch wide vertical braces in the trench at intervals of six to 10 feet therealong thereby providing temporary support for the side walls of the trench.

9. The method of claim 1, wherein the step of excavating a vertical barrier trench comprises the step of:

providing a vertical barrier trench having a nominal width not exceeding three inches and having a full depth of approximately five feet for use in soils having a relatively high plasticity index that are subject to shrinking and swelling.

10. The method of claim 1, wherein the step of excavating a vertical barrier trench a predetermined distance outside the grade beam comprises the step of:

spacing the vertical barrier trench a distance beyond the location of the grade beam of at least the nominal thickness of the grade beam of the slab foundation.

11. The method of claim 1, wherein the step of excavating a vertical barrier trench comprises the step of:

excavating the vertical barrier trench using a device selected from the group consisting of a mechanism configured in the manner of a chain saw, a circular saw, a knife, and a back hoe.

12. The method of claim 1, wherein the step of installing the moisture barrier membrane comprises the steps of:

installing an exterior form board for the slab foundation, such that its inside surface is disposed above an outer wall of the vertical barrier trench;

extending the membrane from the bottom of the vertical barrier trench to an extension at least 20 inches above the surface grade; and draping the excess vertical moisture barrier membrane outward over the form board.

* * * * *